United States Patent [19]

Nakagawa

[11] 4,028,881

[45] June 14, 1977

[54] MECHANISM FOR CORRECTING CALENDAR IN A WATCH

[75] Inventor: Yasuichi Nakagawa, Kashiwa, Japan

[73] Assignee: Kabushiki Kaisha Daini Seikosha, Japan

[22] Filed: July 17, 1975

[21] Appl. No.: 596,607

[30] Foreign Application Priority Data

July 26, 1974 Japan ..... 49-85899[U]

[52] U.S. Cl. ..... 58/58; 58/63; 58/73

[51] Int. Cl.[2] ..... G04B 19/24

[58] Field of Search ..... 58/4 R, 58, 59, 63, 58/73, 85.5

[56] References Cited

UNITED STATES PATENTS

| | | | |
|---|---|---|---|
| 3,470,687 | 10/1969 | Ono et al. | 58/58 |
| 3,470,688 | 10/1969 | Miyasaka | 58/58 |
| 3,659,413 | 5/1972 | Tanaka et al. | 58/58 |
| 3,662,534 | 5/1972 | Colomb | 58/58 |
| 3,691,756 | 9/1972 | Ono | 58/58 |
| 3,732,687 | 5/1973 | Miyasaka et al. | 58/58 |
| 3,775,966 | 12/1973 | Matsuura | 58/58 |

*Primary Examiner*—Stanley J. Witkowski
*Attorney, Agent, or Firm*—Robert E. Burns; Emmanuel J. Lobato; Bruce L. Adams

[57] ABSTRACT

A calendar watch has rotatable date and day wheels each having teeth therearound. A winding stem is mounted on the watch for axial sliding movement and rotational movement and a correcting wheel is mounted for axial sliding movement on the winding stem. The correcting wheel has a first set of teeth engageable with teeth on the date wheel when the winding stem is moved to one axial position for effecting rotational movement of the date wheel to thereby make a date correction in response to turning of the winding stem in one rotational direction. The correcting wheel has a second set of teeth engageable with teeth on the day wheel when the winding stem is in the same axial position for effecting rotational movement of the day wheel to thereby make a day correction in response to turning of the winding stem in the other rotational direction.

2 Claims, 4 Drawing Figures

MECHANISM FOR CORRECTING CALENDAR IN A WATCH

BACKGROUND OF THE INVENTION

This invention relates to a mechanism for correcting the calendar in a watch in which a correcting wheel has two feed gears for rotating a day wheel and date wheel.

In the conventional mechanism of this sort, many parts are required. In general since a day correction is effected by means of a plurality of parts from a setting lever to a clutch lever and of gear wheels, the mechanism becomes complex and relatively expensive to manufacture and maintain.

OBJECT OF THE INVENTION

The present invention aims to eliminate the above noted difficulty and insufficiency, and therefore it is the primary object of the present invention to provide a calendar correcting mechanism in a watch which has a simple construction for rotating the day and date wheels by a correcting mechanism with a high degree of accuracy.

SUMMARY OF THE INVENTION

According to the present invention, there is provided a calendar correcting mechanism comprising a correcting wheel, a date wheel, a day wheel, and two sets of feed teeth disposed on the correcting wheel. The sets of feed teeth are shifted 90° with respect to each other so that the day wheel engages one set of feed teeth and is rotated in one direction by the rotation of said correcting wheel in one direction; and the date wheel engages the other set of feed teeth and is rotated in the other direction by the rotation of said correcting wheel in the other direction.

BRIEF DESCRIPTION OF THE DRAWINGS

The above mentioned and further objects, features and advantages of the present invention will become more obvious from the following description when taken in connection with the accompanying drawings, which show one preferred embodiment, and wherein.

DETAILED DESCRIPTION OF THE INVENTION

This invention relates to the improvement of a calendar correcting mechanism.

Figure 1:
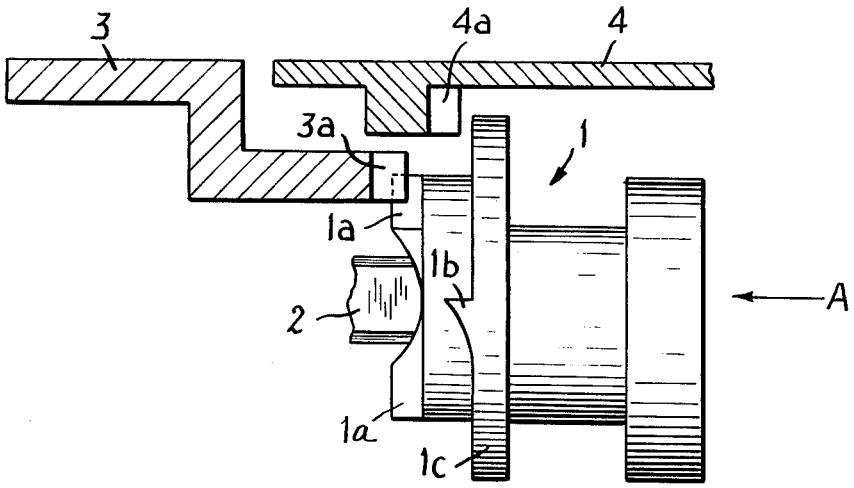
FIG. 1 shows a sectional view of the present invention.
Figure 2:
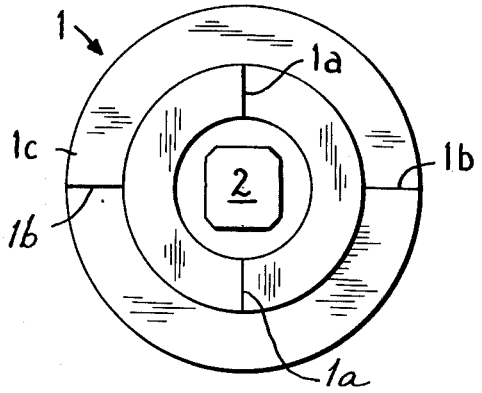
FIG. 2 shows a front view of a correcting wheel in FIG. 1.

Referring now to the preferred embodiment shown, in FIG. 1, a correcting wheel 1 is axially slidably mounted on the square portion of a winding stem 2. The correcting wheel 1 is positioned in a calendar correcting position or state under the actions of a setting lever and a clutch lever (not shown) by pulling out the winding stem 2.

In the calendar correcting state, the correcting wheel is biased leftward in the direction indicated by arrow "A".

The correcting wheel 1 is provided with a set of first feed teeth l*a* and l*a* at symmetrical portions of the end surface thereof. The first feed teeth of the correcting wheel engage with teeth 32 of a date wheel 3 to make it rotate in a counterclockwise direction when the correcting wheel 1 is turned in the counterclockwise direction, that is the direction indicated by the arrow "B" in FIG. 3(A). During turning of the correcting wheel in the other direction, that is the clockwise direction, the first feed teeth disengage from the teeth 32 of the date wheel 3. In this case, the correcting wheel 1 escapes from the engagement position because it is backed against the resilience of the clutch lever mentioned above.

Further, the correcting wheel 1 is provided with a set of second feed teeth 1*b* and 1*b* at the front surface of a flange 1*c* provided thereon. The second feed teeth 1*b* and 1*b* are shifted circumferentially by an angle of 90° with respect to the first feed teeth 1*a* and 1*a*.

Figure 3A:
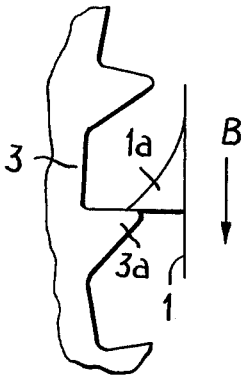
FIGS. 3A and 3B are explanatory views showing a state where a date and a day wheels are driven.
Figure 3B:
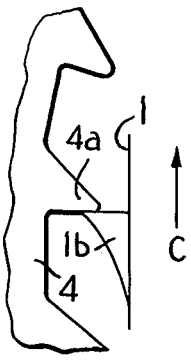

Therefore, when the correcting wheel 1 is turned in the clockwise direction, that is the direction indicated by the arrow mark "C" shown in FIG. 3(B), the second feed teeth 1*b* and 1*b* of the correcting wheel 1 engage with teeth 4*a* of a day wheel 4 to make the day wheel rotate in the clockwise direction. On the other hand, when the correcting wheel 1 is turned in the counterclockwise direction, the second feed teeth 1*b* and 1*b* disengage from the teeth 4*a* of the day wheel 4 because the correcting wheel is backed against the resiliency of the clutch lever.

Next, the operation of the calendar correcting mechanism will be fully described.

When a date correction is to be effected, the correcting wheel 1 is positioned in a calendar correction position by pulling out the winding stem, and the wheel is turned in the counterclockwise direction, that is the direction indicated by the arrow B as shown in FIG. 3(A), so that the first feed teeth 1*a* and 1*a* engage with the teeth 32 of the date wheel 3.

As a result, the day wheel is able to be rotated in the counterclockwise direction. In this case, since the correcting wheel is provided with second feed teeth 1*b* and 1*b* which are shifted by 90° with respect to the first feed teeth, the correcting wheel engages with the date wheel 3 but it is not in engagement with the day wheel 4.

Then, after engaging with the date wheel 3, the correcting wheel 1 comes in contact with the day wheel 4. It is to be noted that the correcting wheel rotates in the counterclockwise direction so that the second feed teeth thereof are not able to engage with the teeth 4*a* of the day wheel 4. That is, in this case, the correcting wheel 1 moves backward with the second feed teeth escaped from the teeth 4*a* of the day wheel 4, and then it is positioned again in the engagement position of the day wheel under the action of the clutch lever after passing over the teeth 4*a* of the day wheel.

In case of a day correction, it is sufficient to turn the correcting wheel 1 in the counterclockwise direction. The second feed teeth 1*b* and 1*b* of the correcting wheel 1 engage with the teeth 4*a* of the day wheel 4, so that the correcting wheel may rotate in the clockwise direction. However, the first feed teeth 1*a* and 1*a* of the correcting wheel 1 do not engage with the teeth 3*a* of the date wheel in the same manner as the second feed teeth 1*b* and 1*b* avoid engagement with the date wheel 3.

It is appreciated that the number of feed teeth and the relative position of the feed teeth is not restricted to the herein disclosed embodiment.

For instance, it is possible that the date wheel and the day wheel be provided with a feed teeth, respectively and that the correcting wheel be provided with the second feed teeth in an opposite side to the first feed teeth.

Further, it is possible to substitute the clutch wheel provided with a pair of feed teeth for the correcting wheel 1.

As mentioned above, the present invention brings about many advantages as follows: the calendar correcting mechanism according to the present invention is very simple in construction as compared with conventional mechanisms of this kind, has few parts, and it effects an accurate calendar correction.

What we claimed is:

1. In a calendar watch: a rotatable date wheel having teeth therearound; a rotatable day wheel having teeth therearound; an axially slidable winding stem mounted for rotation; and means including a correcting wheel mounted for axial sliding movement on said winding stem and having a first set of teeth engageable with teeth on said date wheel when said winding stem is in a predetermined axial position for effecting rotational movement of said date wheel to make a date correction in response to turning of said winding stem in one rotational direction and having a second set of teeth engageable with teeth on said day wheel when said winding stem is in said predetermined axial position for effecting rotational movement of said day wheel to make a day correction in response to turning of said winding stem in the other rotational direction.

2. A calendar watch according to claim 1; wherein said means includes means for preventing engagement of the correcting wheel first set of teeth with the date wheel teeth during turning of said winding stem in said other rotational direction and means for preventing engagement of the correcting wheel second set of teeth with the day wheel teeth during turning of said winding stem in said one rotational direction.

* * * * *